US011298909B2

(12) United States Patent
Totani

(10) Patent No.: US 11,298,909 B2
(45) Date of Patent: Apr. 12, 2022

(54) PLASTIC BAG MAKING APPARATUS AND METHOD

(71) Applicant: Totani Corporation, Kyoto (JP)

(72) Inventor: Mikio Totani, Kyoto (JP)

(73) Assignee: TOTANI CORPORATION, Kyoto (JP)

( * ) Notice: Subject to any disclaimer, the term of this patent is extended or adjusted under 35 U.S.C. 154(b) by 0 days.

(21) Appl. No.: 17/223,334

(22) Filed: Apr. 6, 2021

(65) Prior Publication Data

US 2021/0221568 A1 Jul. 22, 2021

Related U.S. Application Data

(62) Division of application No. 16/175,982, filed on Oct. 31, 2018, now Pat. No. 11,001,414, which is a (Continued)

(30) Foreign Application Priority Data

Jul. 24, 2015 (JP) ..... JP2015-146422

(51) Int. Cl.

| | |
|---|---|
| ***B65D 33/00*** | (2006.01) |
| ***B31B 70/64*** | (2017.01) |
| ***B65D 30/20*** | (2006.01) |
| ***B65D 33/01*** | (2006.01) |
| ***B31B 50/81*** | (2017.01) |
| ***B31B 70/855*** | (2017.01) |

(Continued)

(52) U.S. Cl.

CPC ..... *B31B 70/645* (2017.08); *B31B 50/81* (2017.08); *B31B 70/00* (2017.08); *B31B 70/855* (2017.08); *B65D 31/10* (2013.01); *B65D 33/002* (2013.01); *B65D 33/01* (2013.01); *B31B 2155/00* (2017.08); *B31B 2155/002* (2017.08); *B31B 2160/10* (2017.08); *B31B 2160/20* (2017.08)

(58) Field of Classification Search

CPC ..... B65D 33/002; B65D 31/10; B65D 33/01; B65D 30/20; B31B 50/81; B31B 70/00; B31B 70/26; B31B 70/266; B31B 2105/00; B31B 2155/002; B31B 2160/10; B31B 2160/20

USPC ..... 493/68, 69, 79, 127; 383/120

See application file for complete search history.

(56) References Cited

U.S. PATENT DOCUMENTS

| | | | |
|---|---|---|---|
| 4,759,643 | A | 7/1988 | Canno |
| 2004/0057636 | A1 | 3/2004 | Ishizaki |

(Continued)

FOREIGN PATENT DOCUMENTS

| | | |
|---|---|---|
| EP | 0314247 | 5/1989 |
| JP | 3733085 | 1/2004 |

(Continued)

OTHER PUBLICATIONS

European Search Report in Counterpart European Application No. 16180522, dated Dec. 7, 2016.

*Primary Examiner* — Andrew M Tecco
*Assistant Examiner* — Jacob A Smith
(74) *Attorney, Agent, or Firm* — Kirschstein, Israel, Schiffmiller & Pieroni, P.C.

(57) ABSTRACT

In a plastic bag including a triangular flap which has a folded hypotenuse and an open hypotenuse, a flow path is formed by the folded hypotenuse or the open hypotenuse to discharge air or gas through the flow path.

2 Claims, 7 Drawing Sheets

Related U.S. Application Data division of application No. 15/213,497, filed on Jul. 19, 2016, now Pat. No. 10,189,608.

(51) Int. Cl.

| | |
|---|---|
| ***B31B 70/00*** | (2017.01) |
| *B31B 160/10* | (2017.01) |
| *B31B 155/00* | (2017.01) |
| *B31B 160/20* | (2017.01) |

(56) References Cited

U.S. PATENT DOCUMENTS

| | | | | |
|---|---|---|---|---|
| 2004/0258332 | A1* | 12/2004 | Totani | B65D 31/10 383/120 |
| 2008/0152266 | A1 | 6/2008 | Bergmann | |

FOREIGN PATENT DOCUMENTS

| | | | | |
|---|---|---|---|---|
| JP | 3328124 | | 4/2005 | |
| JP | 5631154 | | 5/2012 | |
| JP | 2012091807 | | 5/2012 | |
| JP | 2012091807 | A * | 5/2012 | B65D 33/01 |

* cited by examiner

PLASTIC BAG MAKING APPARATUS AND METHOD

TECHNICAL FIELD

The invention relates to a plastic bag. In addition, the invention relates to an apparatus for making the plastic bags successively.

BACKGROUND

Each of Japanese Patent Publication No. 3,733,085 and Japanese Patent Publication No. 3,826,124 discloses a plastic bag formed of two sheets of panel material and a pair of sheets of side gusset material. The sheets of panel material are superposed with each other to have opposite side edges. The sheets of side gusset material extend along the opposite side edges. In addition, each of the sheets of side gusset material is folded into halves and interposed between the sheets of panel material to have a folded inner edge and open outer edges.

Each of the sheets of side gusset material further has opposite end portions one of which is folded obliquely along a folded line as it is folded into halves so that a triangular flap is formed by the end portion to be shaped into a triangle having a base formed by the folded line. Each of the sheets of side gusset material further has opposite end edges. The triangle further has an apex formed by an intersection between one of the opposite end edges and the folded inner edge of each of the sheets of side gusset material. The triangular flap has a folded hypotenuse formed by the folded inner edge. The triangular flap further has an open hypotenuse formed by the end edge.

The sheets of panel material, the sheets of side gusset material and the triangular flaps are heat sealed with each other along the opposite side edges of the sheets of panel material. The sheets of panel material and the sheet of side gusset material can therefore be closed to each other by means of the triangular flap with a sealing strength enough to be free of leakage from the end portion of the sheet of side gusset material.

Japanese Patent Publication No. 5,631,154 also discloses the plastic bag including the triangular flap formed of each of the sheets of side gusset material. In addition, in the plastic bag, the triangular flap includes a flat surface in which an aperture is formed to discharge air through the aperture. The aperture is intended to discharge gas through the aperture in addition to the air, when the gas generates in the plastic bag. In this case, insects or foreign substances are less likely to enter the aperture, in particular when the aperture is small.

However, in order to make the plastic bags successively in an apparatus, in which each of the plastic bags includes the aperture formed in the flat surface of the triangular flap, the apparatus has to be arranged to make the sheet of side gusset material punched by a punch blade before being supplied so that the aperture can be formed in the sheet of side gusset material. As a result, the apparatus must be complicated in structure and high in cost. It is therefore desired to discharge the air or the gas in a way different from the plastic bag of the publication.

It is therefore an object of the invention to provide an improved plastic bag including the triangular flap formed of each of the sheets of side gusset material, to discharge air or gas in a way different from the prior art.

SUMMARY OF THE INVENTION

According to the invention, the plastic bag includes two sheets of panel material superposed with each other to have opposite side edges. The plastic bag further includes a pair of sheets of side gusset material extending along the opposite side edges. Each of the sheets of side gusset material is folded into halves and interposed between the sheets of panel material to have a folded inner edge and open outer edges. Each of the sheets of side gusset material further has opposite end portions one of which is folded obliquely along a folded line as it is folded into halves so that a triangular flap is formed by the end portion to be shaped into a triangle having a base formed by the folded line. Each of the sheets of side gusset material further has opposite end edges. The triangle further has an apex formed by an intersection between one of the opposite end edges and the folded inner edge of the sheet of side gusset material. The triangular flap has a folded hypotenuse formed by the folded inner edge. The triangular flap further has an open hypotenuse formed by the end edge. The sheets of panel material, the sheets of side gusset material and the triangular flaps are heat sealed with each other along the opposite side edges of the sheets of panel material. The plastic bag is characterized by a flow path formed by the folded hypotenuse or the open hypotenuse to discharge air or gas through the flow path.

In a preferred embodiment, the triangular flap has the open hypotenuse spaced from the open outer edges of the sheet of side gusset material. The sheets of panel material and the sheet of side gusset material are heat sealed with each other between the open hypotenuse and the open outer edges.

The triangular flap may have the open hypotenuse aligned with the open outer edges of the sheet of side gusset material.

In addition, a notch is formed in the folded hypotenuse of the triangular flap. The flow path is formed by the notch.

In another embodiment, the folded line is inclined at an angle larger than 45° with respect to the open outer edges of the sheet of side gusset material so that the flow path is formed by the open hypotenuse of the triangular flap at a position adjacent to the intersection between the folded hypotenuse and the open hypotenuse of the triangular flap.

In another embodiment, the triangular flap is removed partially at a position adjacent to the intersection between the folded hypotenuse and the open hypotenuse to make a removed portion formed. The flow path is formed by the removed portion.

A notch may be formed in the open hypotenuse of the triangular flap. The flow path is formed by the notch.

In another embodiment, the triangular flap has the open hypotenuse spaced from the open outer edges of the sheet of side gusset material. The sheets of panel material, the sheet of side gusset material and the triangular flap are heat sealed with each other except a non-sealed portion formed partially. The flow path is formed by the open hypotenuse and the non-sealed portion.

Furthermore, the invention provides an apparatus for making plastic bags successively. The apparatus includes a panel feeder by which two webs of panel material are superposed with each other and fed longitudinally thereof and intermittently. The apparatus further includes a side gusset supply by which a web of side gusset material is supplied to one of the webs of panel material and cut into a sheet of side gusset material after being folded into halves whenever the webs of panel material are fed intermittently. The sheet of side gusset material is disposed widthwise of and interposed between the webs of panel material. The sheet of side gusset material has a folded inner edge and open outer edges. The sheet of side gusset material further has opposite end portions. The apparatus further includes a side gusset folder by which one of the opposite end portions of the sheet of side gusset material is folded obliquely along a folded line as it is folded into halves after or before the sheet of side gusset material is supplied so that a triangular flap is formed by the end portion to be shaped into a triangle having a base formed by the folded line. The sheet of side gusset material further has opposite end edges. The triangle has an apex formed by an intersection between one of the opposite end edges and the folded inner edge of the sheet of side gusset material. The triangular flap further has a folded hypotenuse formed by the folded inner edge. The triangular flap further has an open hypotenuse formed by the end edge. The apparatus further includes a heat seal device by which the webs of panel material, the sheet of side gusset material and the triangular flap are heat sealed with each other widthwise of the webs of panel material whenever the webs of panel material are fed intermittently. The apparatus further includes a cutter by which the webs of panel material are cut widthwise thereof into sheets of panel material whenever being fed intermittently to make plastic bags successively of the sheets of panel material and the sheet of side gusset material. The apparatus is characterized by a flow path formed by the folded hypotenuse or the open hypotenuse when making the plastic bags successively, to discharge air or gas through the flow path.

BEST MODE TO CARRY OUT THE INVENTION

Figure 1A:
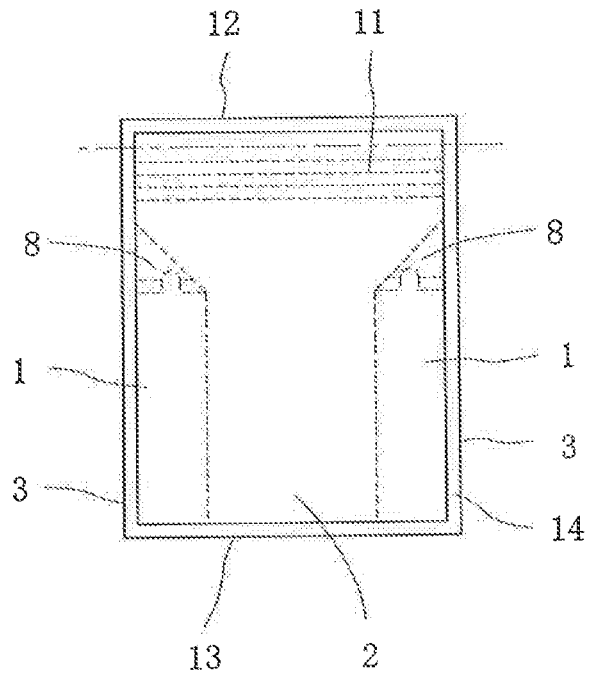
FIG. 1A is a plan view of the plastic bag according to the invention.
Figure 1B:
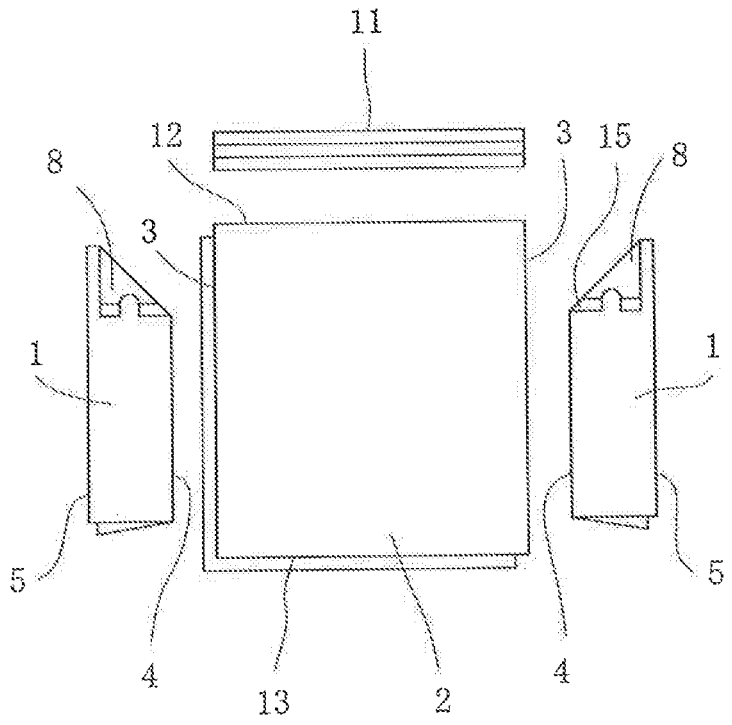
FIG. 1B is an explosive view of the plastic bag of FIG. 1A.

Turning now to the drawings, FIGS. 1A-1B illustrate a plastic bag including a pair of sheets of side gusset material 1, according to the invention. The plastic bag further includes two sheets of panel material 2 superposed with each other to have opposite side edges 3. The sheets of side gusset material 1 extend along the opposite side edges 3. In addition, each of the sheets of side gusset material 1 is folded into halves and interposed between the sheets of panel material 2 to have a folded inner edge 4 and open outer edges 5.

Figure 2A:
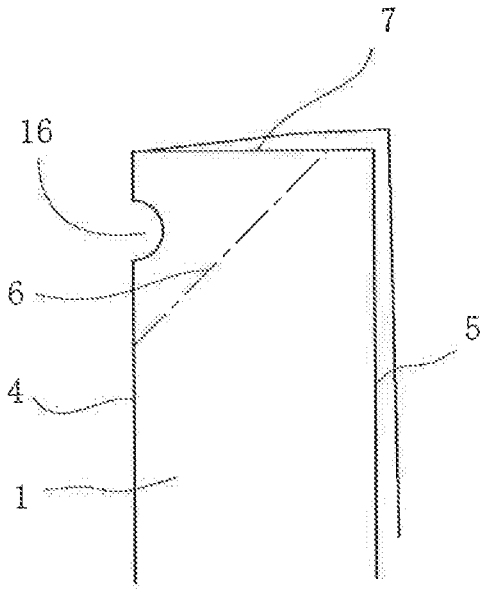
FIG. 2A is an explanatory view of the sheet of side gusset material of FIGS. 1A-1B.
Figure 2B:
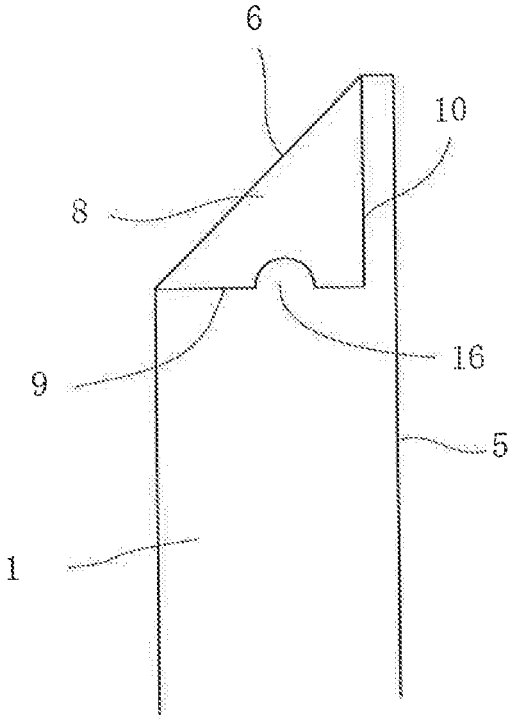
FIG. 2B is an explanatory view of the sheet of side gusset material of FIG. 2A when being folded obliquely.

Each of the sheets of side gusset material 1 further has opposite end portions one of which is folded obliquely along a folded line 6 as it is folded into halves, as shown in FIGS. 2A-2B. Each of the sheets of side gusset material 1 further has opposite end edges 7. A triangular flap 8 is therefore formed by the end portion to be shaped into a triangle having a base formed by the folded line 6. The triangle further has an apex formed by an intersection between one of the opposite end edges 7 and the folded inner edge 4 of the sheet of side gusset material 1. The triangular flap 8 has a folded hypotenuse 9 formed by the folded inner edge 4. The triangular flap 8 further has an open hypotenuse 10 formed by the end edge 7.

A fastener 11 is incorporated into the plastic bag, as in the case of the plastic bag of Japanese Patent Publication No. 3,733,085 and Japanese Patent Publication No. 3,826,124. The sheets of panel material 2 have opposite end edges 12 and 13. The fastener 11 extends along one of the opposite end edges 12.

The sheets of panel material 2, the sheets of side gusset material 1 and the triangular flaps 8 are heat sealed with each other along the opposite side edges 3 of the sheets of panel material 2. The sheets of panel material 2 and the sheet of side gusset material 1 can therefore be closed to each other by means of the triangular flap 8 with a sealing strength enough to be free of leakage from the end portion of the sheet of side gusset material 1.

It should be understood that in the embodiment, the sheets of panel material 2 and the sheets of side gusset material 1 are heat sealed with each other along the opposite side edges 3 of the sheets of panel material 2 while the sheets of panel material 2 and the triangular flaps 8 are heat sealed with each other along the opposite side edges 3. The triangular flaps 8 and the sheets of side gusset material 1 are also heat sealed with each other along the opposite side edges 3. In addition, the sheets of panel material 2 are heat sealed with each other along one of the opposite end edges 12 and along the other end edge 13. A heat sealed portion 14 is therefore formed along the opposite side edges 3, along one of the opposite end edges 12 and along the other end edge 13. Furthermore, the triangular flap 8 and the sheet of side gusset material 1 are heat sealed with each other along the folded hypotenuse 9 of the triangular flap 8 so that a heat sealed portion 15 is formed along the folded hypotenuse 9, as also in the case of the plastic bag of the publications.

By the way, each of the sheets of panel material 2 and the sheet of side gusset material 1 comprises a laminated film composed of a sealant laminated on a base material. The sheet of panel material 2 has an inner surface formed by the sealant and an outer surface formed by the base film when the sheets of panel material 2 are superposed with each other. The sheet of side gusset material 1 has an outer surface formed by the sealant and an inner surface formed by the base material when being folded into halves. The sheets of panel material 2, the sheet of side gusset material 1 and the triangular flap 8 can therefore be heat sealed with each other by the sealant. The sheets of panel material 2 can be heat sealed with each other by the sealant, as also in the case of the plastic bag of the publications.

The plastic bag is characterized by a flow path formed by the folded hypotenuse 9 or the open hypotenuse 10 to discharge air or gas through the flow path.

Figure 3A:
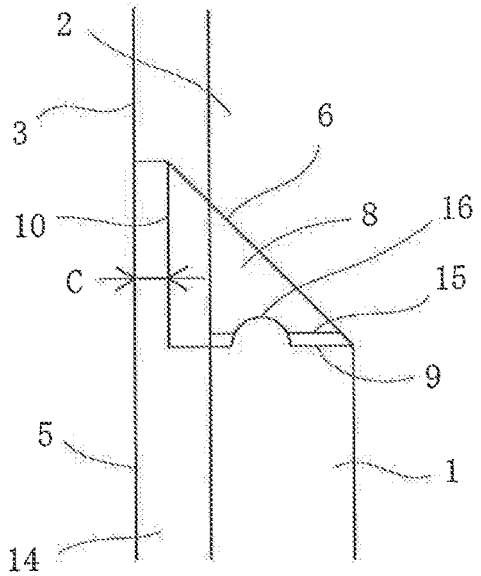
FIG. 3A is an explanatory view of the sheets of panel material, the sheet of side gusset material and the triangular flap of FIGS. 1A-1B.
Figure 3B:
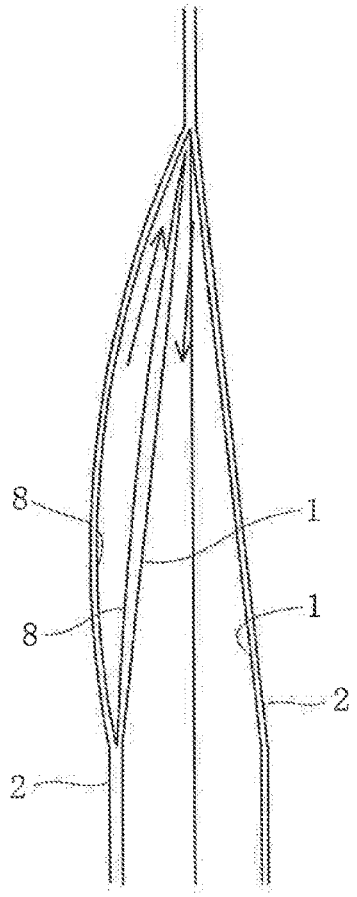
FIG. 3B is a sectional view of the sheets of panel material, the sheet of side gusset material and the triangular flap of FIG. 3A.

In the embodiment, the triangular flap 8 has the open hypotenuse 10 not aligned with but spaced from the open outer edges 5 of the sheet of side gusset material 1 at a distance C, as shown in FIG. 3A. In addition, the sheets of panel material 2, the sheet of side gusset material 1 and the triangular flap 8 are heat sealed with each other along the side edge 3 of the sheets of panel material 2. Accordingly, the sheets of panel material 2 and the sheet of side gusset material 1 are heat sealed with each other between the open hypotenuse 10 and the open outer edges 5 so that the open hypotenuse 10 can be closed by the heat sealed portion 14.

In addition, a notch 16 is formed in the folded hypotenuse 9 of the triangular flap 8 to be positioned off the heat sealed portion 14 formed along the side edges 3 of the sheets of panel material 2. The notch 16 extends beyond the heat sealed portion 15 formed along the folded hypotenuse 9 of the triangular flap 8, to reach an area in which the triangular flap 9 is not heat sealed.

In the plastic bag, the sheet of side gusset material 1 is folded into halves to be superposed into two layers. The triangular flap 8 is formed of the sheet of side gusset material 1 to be superposed into two layers. In addition, the notch 16 is formed in each of the layers of the triangular flap 8.

Accordingly, the flow path is formed by the notch 16 to discharge air or gas through the flow path. For example, the air passes through the notch 16 to be directed into the triangular flap 8. The air then passes across the folded line 6 of the triangular flap 8 to be directed between the two halves into which the sheet of side gusset material 1 is folded, for discharging the air out of the sheet of side gusset material 1 at the side edges 3 of the sheets of panel material 2. In addition, gas passes through the notch 16 to be directed into the triangular flap 8 when the gas generates in the plastic bag, for discharging the gas out of the sheet of side gusset material 1 at the side edges 3.

In the meantime, insects or foreign substances are kept from entering the flow path by the folded line 6 of the triangular flap 8. In addition, the notch 16 is formed in the folded hypotenuse 9 of the triangular flap 8, which is the obliquely folded portion of the sheet of side gusset material 1. Accordingly, the insects or the foreign matters are less likely to enter the flow path.

It is clear that the plastic bag can discharge the air or the gas in a way different from the plastic bag of Japanese Patent Publication No. 5,631,154. It is also clear that when making the plastic bags successively in an apparatus, the apparatus does not have to be arranged to make the sheet of side gusset material punched by a punch blade before being supplied so that an aperture can be formed in the sheet of side gusset material.

Figure 4A:
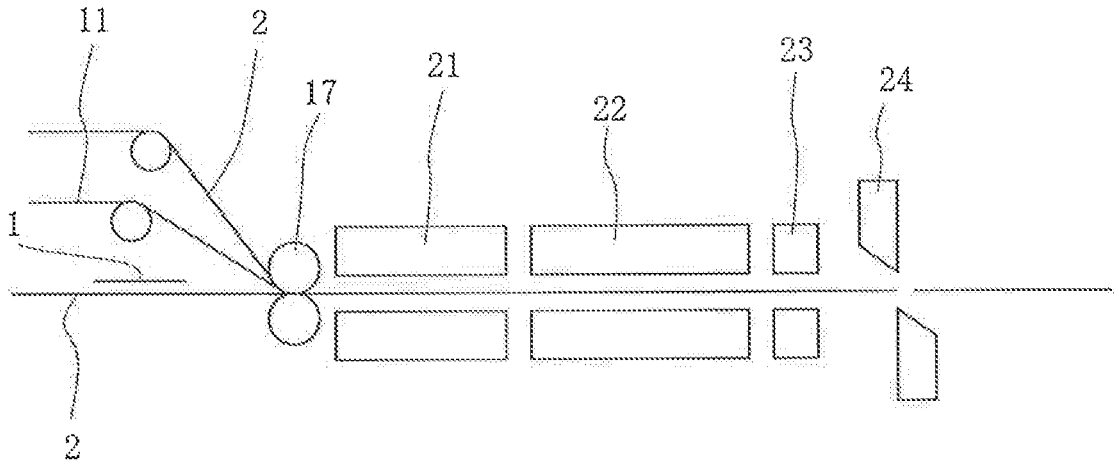
FIG. 4A is a side view of the apparatus for making the plastic bags of FIGS. 1A-1B successively.
Figure 4B:
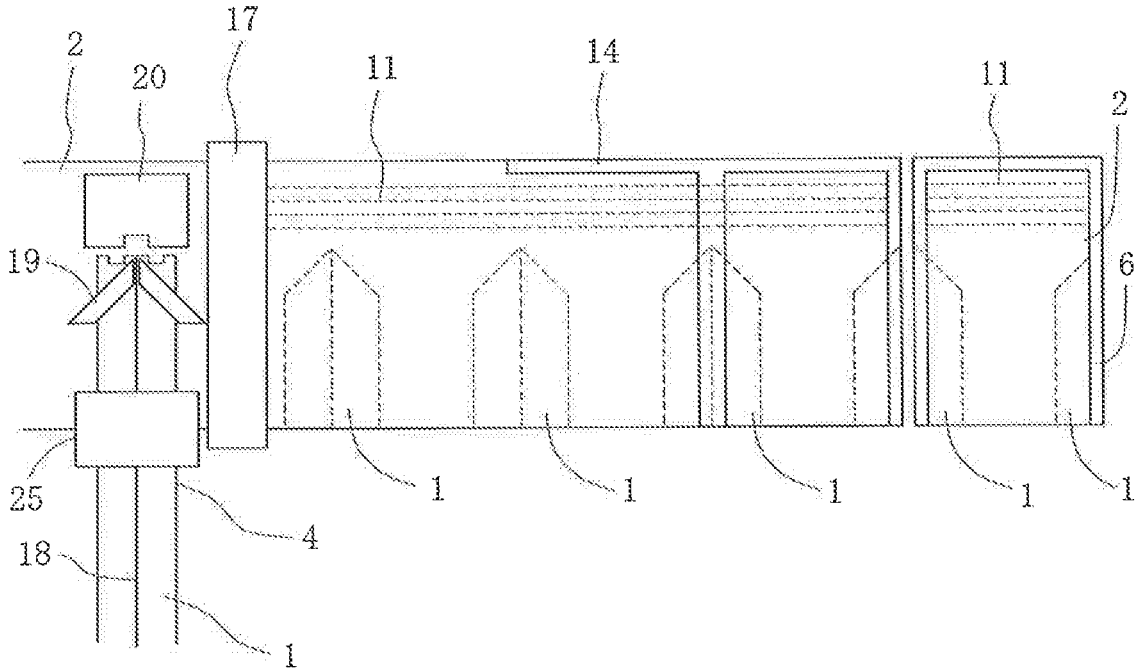
FIG. 4B is a plan view of the webs of panel material of FIG. 4A.

FIGS. 4A-4B illustrate an apparatus for making the plastic bags successively, of FIG. 1A. The apparatus includes a panel feeder by which two webs of panel material 2 are superposed with each other and fed longitudinally thereof and intermittently, as in the case of the apparatus of Japanese Patent Publication No. 3,733,085. The panel feeder comprises feed rollers 17. The apparatus further includes a side gusset supply by which a web of side gusset material 1 is supplied to one of the webs of panel material 2 and cut into the sheet of side gusset material after being folded into halves whenever the webs of panel material 2 are fed intermittently. For example, the web of side gusset material 1 is folded into halves previously. It is then supplied to the web of panel material 2 before the webs of panel material 2 are superposed with each other whenever being fed intermittently. In addition, the web of side gusset material 1 has a double width, which is folded into halves on opposite sides of the longitudinal centerline 18 thereof, as also in the case of the apparatus of the publication. Subsequently, the web of side gusset material 1 is cut into the sheet of side gusset material. The side gusset supply comprises a conveyor belt or the like. The webs of panel material 2 are then superposed with each other so that the sheet of side gusset material 1 is disposed widthwise of and interposed between the webs of panel material 2. At the same time, the fastener 11 is directed to and inserted between the webs of panel material 2. The sheet of side gusset material 1 has the folded inner edge 4 and the open outer edges 5. The sheet of side gusset material 1 further has the opposite end portions.

The apparatus further includes a side gusset folder by which one of the opposite end portions of the sheet of side gusset material 1 is folded obliquely along the folded line 6 as it is folded into halves after or before the sheet of side gusset material 1 is supplied so that the triangular flap 8 is formed by the end portion to be shaped into the triangle having the base formed by the folded line 6. The sheet of side gusset material 1 further has the opposite end edges 7. The triangle has the apex formed by the intersection between one of the opposite end edges 7 and the folded inner edge 4 of the sheet of side gusset material 1. The triangular flap 8 further has the folded hypotenuse 9 formed by the folded inner edge 4. The triangular flap 8 further has the open hypotenuse 10 formed by the end edge 7. The side gusset folder comprises a triangular plate 19 and a paddle 20, as also in the case of the apparatus of the publication.

The webs of panel material 2 are then directed to a heat seal device 21 by which the webs of panel material 2 and the fastener 11 are heat sealed with each other longitudinally thereof whenever the webs of panel material 2 are fed intermittently. The webs of panel material 2 are then directed to a heat seal device 22 to be heat sealed with each other longitudinally thereof whenever being fed intermittently. The webs of panel material 2 are then directed to a heat seal device 23 by which the webs of panel material 2, the sheet of side gusset material 1 and the triangular flap 8 are heat sealed with each other widthwise of the webs of panel material 2 whenever the webs of panel material 2 are fed intermittently. They are heat sealed with each other at a position corresponding to the longitudinal centerline 18 of the sheet of side gusset material 1. The webs of panel material 2 is then directed to a cutter 24 to be cut widthwise thereof into the sheets of panel material 2 whenever being fed intermittently. In the embodiment, the webs of panel material 2 and the sheet of side gusset material 1 are cut widthwise of the webs of panel material 2 at a position corresponding to the longitudinal centerline 18 of the sheet of side gusset material 1.

The apparatus therefore makes the plastic bag successively and of the sheets of panel material 2 and the sheet of side gusset material 1. The plastic bag includes the heat seal portion 14 formed along one of the opposite end edges 12 of the sheet of panel material 2 when the webs of panel material 2 are heat sealed with each other by the heat seal device 22. The plastic bag further includes the opposite side edges 3 of the sheet of panel material 2 formed when the webs of panel material 2 and the sheet of side gusset material 1 are cut by the cutter 24. The plastic bag further includes the heat seal portion 14 formed along the opposite side edges 3 of the sheet of panel material 2 when the webs of panel material 2, the sheet of side gusset material 1 and the triangular flap 8 are heat sealed by the heat seal device 23.

The plastic bag is filled with content after making the plastic bag. The sheets of the panel material 2 are then heat sealed with each other along the other end edge 13 of the sheet of panel material to make the heat seal portion 14 formed along the other end edge 13.

The apparatus is characterized by the flow path formed by the folded hypotenuse 9 or the open hypotenuse 10 when making plastic bags successively, to discharge the air or the gas through the flow path. For example, the side gusset supply includes a Thomson blade 25 by which the web of side gusset material 1 is cut into the sheet of side gusset material after being folded into halves and after or before being supplied to the web of panel material 2. The notch 16 is formed in the web of side gusset material 1 by the Thomson blade 25 when the web of side gusset material 1 is cut. The triangular flap 8 and the web of side gusset material 1 can be heat sealed with each other to make the heat seal portion 15 formed, after the notch 16 is formed. The sheet of side gusset material 1 is then supplied to the web of panel material 2. The flow path is therefore formed by the notch 16 when making the plastic bags successively.

Accordingly, unlike the plastic bag of Japanese Patent Publication of 5,631,154, the apparatus does not have to be arranged to make the sheet of side gusset material 1 punched by a punch blade before being supplied. The apparatus merely has to make the notch 16 formed in the sheet of side gusset material 1 by the Thomson blade 25 when the web of side gusset material 1 is cut so that the flow path can be formed in the sheet of side gusset material 1, to be simple in structure and low in cost.

It is not always necessary to make the notch 16 formed in each of the layers of the triangular flap 8, as in the case of the embodiment. The notch 16 may be formed in one of the layers of the triangular flap 8.

Figure 5A:
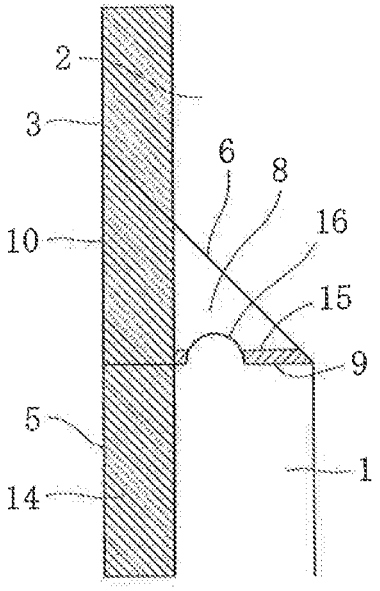
FIG. 5A is an explanatory of another embodiment.

It is also not always necessary to make the open hypotenuse 10 spaced from the open outer edge 5 of the sheet of side gusset material 1. The open hypotenuse 10 may be aligned with the open outer edge 5 (FIG. 5A).

In this case, the open hypotenuse 10 is not closed by the heat seal portion 14. The air or the gas is therefore got out at the side edge 3 of the sheet of panel material 2 after being directed into the triangular flap 8.

It should be noted that in this case, the notch 16 is formed by the folded hypotenuse 9 of the triangular flap 8, which is the obliquely folded portion of the sheet of side gusset material 1. Accordingly, the insects or the foreign substances are less likely to enter the flow path.

Figure 5B:
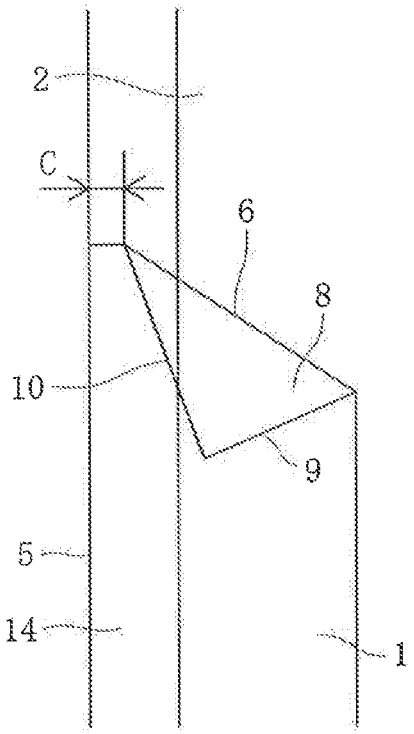
FIG. 5B is an explanatory view of another embodiment.

The folded line 6 may be inclined at an angle larger than 45° with respect to the open outer edge 5 of the sheet of side gusset material 1 so that the open hypotenuse 10 can deviate from the heat seal portions 14 to reach an area not heat sealed in the triangular flap 8 (FIG. 5B). The flow path can therefore be formed by the open hypotenuse 10 at a position adjacent to the intersection between the folded hypotenuse 9 and the open hypotenuse 10 to discharge the air or the gas through the flow path. The open hypotenuse 10 may be spaced from the open outer edges 5 of the sheet of side gusset material 1 at a distance C.

In this case, the air or the gas passes through the open hypotenuse 10 to be directed into the triangular flap 8 for discharging. The triangular flap 8 comprises the obliquely folded portion so that the insects or the foreign substances are less likely to enter.

In order to make the plastic bags successively, the end portion of the sheet of side gusset material 1 should be folded by the triangular plate 19 and the paddle 20 so that the folded line 6 can be formed by the triangular plate 19 to have an angle which is adjusted.

Figure 5C:
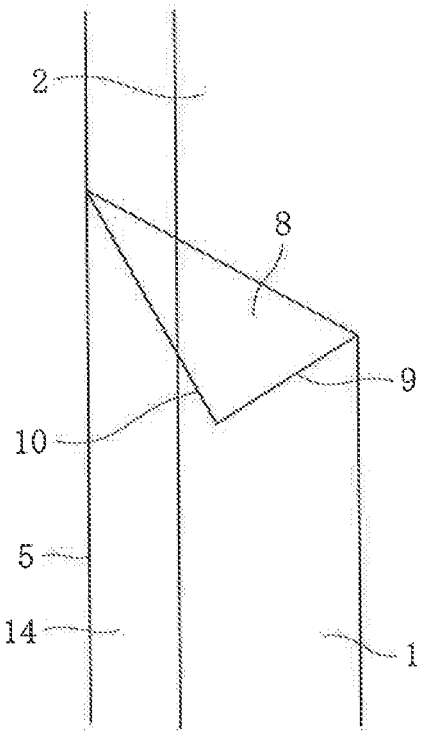
FIG. 5C is an explanatory view of another embodiment.

The triangular flap 8 may have the open hypotenuse 10 reaching the open outer edge 5 (FIG. 5C).

Figure 6A:
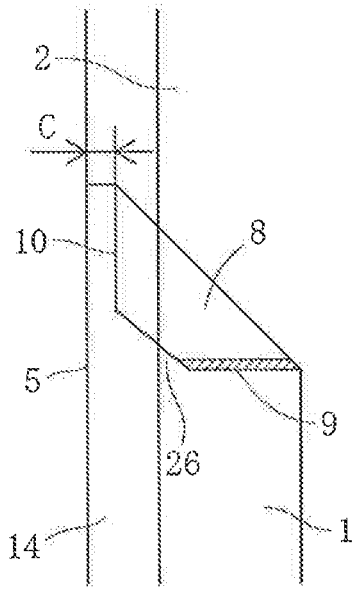
FIG. 6A is an explanatory of another embodiment.

The triangular flap 8 may be removed partially at a position adjacent to the intersection between the folded hypotenuse 9 and the open hypotenuse 10 to make a removed portion 26 formed. The flow path is formed by the removed portion 26 (FIG. 6A). The removed portion 26 may extend along a straight line. The triangular flap 8 may has the open hypotenuses 10 spaced from the open outer edges 5 of the sheet of side gusset material 1 at a distance C.

In this case, the air or the gas passes through the removed portion 26 to be directed into the triangular flap 8 for discharging. The triangular flap 8 comprises the obliquely folded portion so that the insects or the foreign substances are less likely to enter.

In order to make the plastic bags successively, the removed portion 26 should be formed by the Thomson blade 25 when the web of side gusset material 1 is cut by the Thomson blade 25.

Figure 6B:
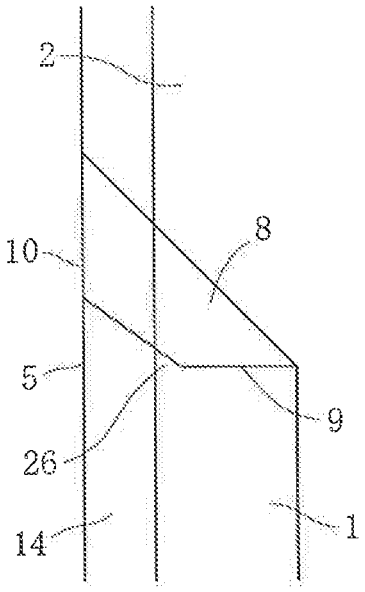
FIG. 6B is an explanatory view of another embodiment.

The triangular flap 8 may have open hypotenuse 10 aligned with the open outer edge 5 of the sheet of side gusset material 1 (FIG. 6B).

Figure 6C:
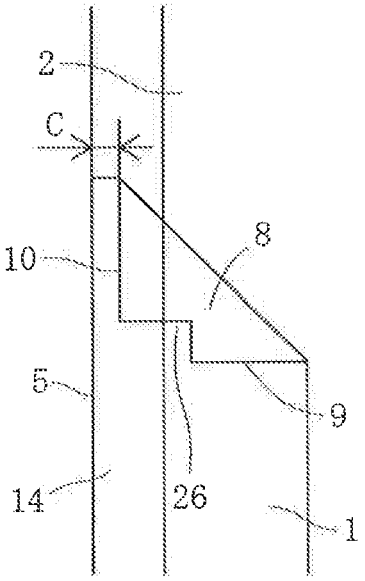
FIG. 6C is an explanatory view of another embodiment.

The removed portion 26 may be formed to be stepped (FIG. 6C). The open hypotenuse 10 may be spaced from the open outer edge 5 at a distance C.

Figure 6D:
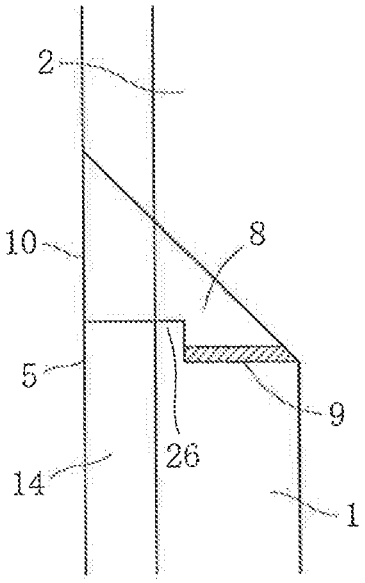
FIG. 6D is an explanatory of another embodiment.

The open hypotenuse 10 may be aligned with the open outer edge 5 of the sheet of side gusset material 1 (FIG. 6D).

Figure 7A:
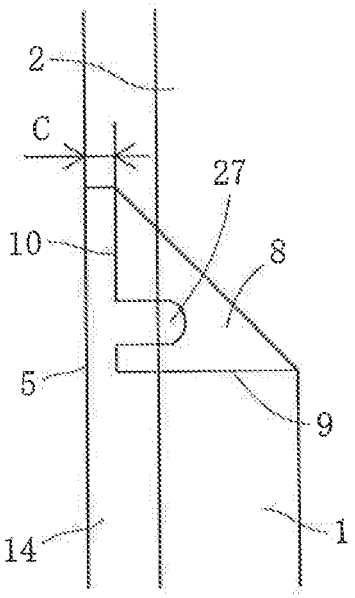
FIG. 7A is an explanatory view of another embodiment.

A notch 27 may be formed in the open hypotenuse 10 of the triangular flap 8 to protrude into the area not heat sealed in the triangular flap 8 (FIG. 7A), so that a flow path can be formed by the notch 27 to discharge the air or the gas through the flow path. The open hypotenuse 10 may be spaced from the open outer edge 5 at a distance C.

In this case, the air or the gas passes through the notch 27 to be directed into the triangular flap 8 for discharging.

In order to make the plastic bags successively, the notch 27 should be formed by the Thomson blade 25 when the web of side gusset material 1 is cut by the Thomson blade 25 in the apparatus of FIG. 4B.

Figure 7B:
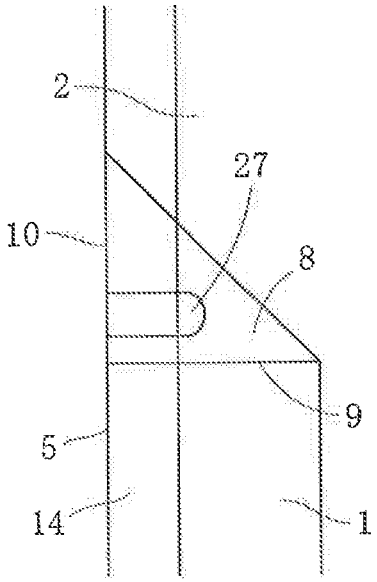
FIG. 7B is an explanatory of another embodiment.

The open hypotenuse 10 may be aligned with the open outer edges 5 of the sheet of side gusset material 1 (FIG. 7B).

Figure 7C:
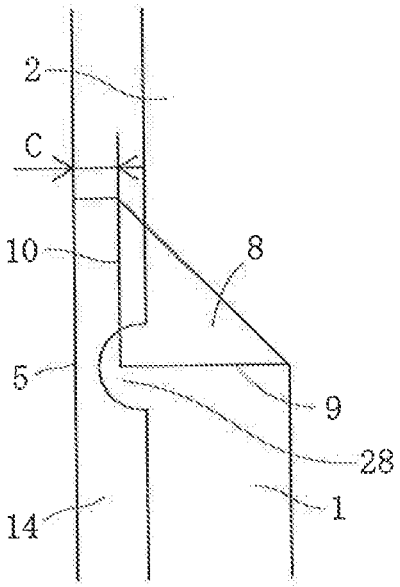
FIG. 7C is an explanatory view of another embodiment.

In another embodiment, the triangular flap 8 has the open hypotenuse 10 spaced from the open outer edge 5 of the sheet of side gusset material 1 at a distance C (FIG. 7C). The webs of panel material 2, the sheet of side gusset material 1 and the triangular flap 8 are heat sealed with each other along the opposite side edges 3 of the webs of panel material 2 except a non-sealed portion 28 formed partially. The flow path is formed by the open hypotenuse 10 and the non-sealed portion 28.

In this case, the air or the gas passes through the open hypotenuse 10 at the non-sealed portion 28 for discharging.

In order to make the plastic bags successively, the webs of panel material 2, the sheet of side gusset material 1 and the triangular flap 8 should be heat sealed with each other by the heat seal device 23 except the non-sealed portion 28 formed partially in the apparatus of FIGS. 4A-4B.

What is claimed is:

1. An apparatus for making plastic bags successively, comprising:

a panel feeder configured to superpose two webs of panel material with each other and to feed the webs of panel material longitudinally thereof and intermittently;

a side gusset supply configured to supply a web of side gusset material to one of the webs of panel material and cut into a sheet of side gusset material after being folded into halves whenever the webs of panel material are fed intermittently, the sheet of side gusset material being disposed widthwise of and interposed between the webs of panel material, the sheet of side gusset material having a folded inner edge and open outer edges, the sheet of side gusset material further having opposite end portions;

a side gusset folder configured to fold one of the opposite end portions of the sheet of side gusset material obliquely along a folded line as it is folded into halves after or before the sheet of side gusset material is supplied so that a triangular flap is formed by the end portion to be shaped into a triangle having a base formed by the folded line, the sheet of side gusset material further having opposite end edges, the triangle having an apex formed by an intersection between one of the opposite end edges and the folded inner edge of the sheet of side gusset material, the triangular flap further having a folded side formed by the folded inner edge, the triangular flap further having an open side formed by the end edge, a blade configured to remove partially the triangular flap at a position adjacent to an intersection between the folded side and the open side to form a removed portion;

a heat seal device configured to heat seal the webs of panel material, the sheet of side gusset material and the triangular flap with each other widthwise of the webs of panel material whenever the webs of panel material are fed intermittently to make a heat seal portion, a part of the removed portion of the triangular flap is deviated from the heat seal portion to reach an area not heat sealed, a flow path is formed by the part of the removed portion of the triangular flap in the area to discharge air or gas through the flow path; and a cutter configured to cut the webs of panel material widthwise thereof into sheets of panel material whenever being fed intermittently to make plastic bags successively of the sheets of panel material and the sheet of side gusset material.

2. A method of making plastic bags successively, comprising:

superposing two webs of panel material with each other and feeding the webs of the panel material longitudinally thereof and intermittently;

supplying a web of side gusset material to one of the webs of panel material and cutting into a sheet of side gusset material after being folded into halves whenever the webs of panel material are fed intermittently, the sheet of side gusset material being disposed widthwise of and interposed between the webs of panel material, the sheet of side gusset material having a folded inner edge and open outer edges, the sheet of side gusset material further having opposite end portions;

folding one of the opposite end portions of the sheet of side gusset material obliquely along a folded line as it is folded into halves after or before the sheet of side gusset material is supplied so that a triangular flap is formed by the end portion to be shaped into a triangle having a base formed by the folded line, the sheet of side gusset material further having opposite end edges, the triangle having an apex formed by an intersection between one of the opposite end edges and the folded inner edge of the sheet of side gusset material, the triangular flap further having a folded side formed by the folded inner edge, the triangular flap further having an open side formed by the end edge, removing partially the triangular flap at a position adjacent to an intersection between the folded side and the open side to form a removed portion;

heat sealing the webs of panel material, the sheet of side gusset material and the triangular flap with each other widthwise of the webs of panel material whenever the webs of panel material are fed intermittently to make a heat seal portion, a part of the removed portion of the triangular flap is deviated from the heat seal portion to reach an area not heat sealed, a flow path is formed by the part of the removed portion of the triangular flap in the area to discharge air or gas through the flow path; and cutting the webs of panel material widthwise thereof into sheets of panel material whenever being fed intermittently to make plastic bags successively of the sheets of panel material and the sheet of side gusset material.

* * * * *